United States Patent [19]

Pinnell et al.

[11] 4,182,401

[45] Jan. 8, 1980

[54] SUPPLEMENTAL HEATING AND COOLING SYSTEM

[76] Inventors: Carrell I. Pinnell, 810 N. Palafox St.; John W. Merting, 421 N. Palafox St., both of Pensacola, Fla. 32501

[21] Appl. No.: 812,315

[22] Filed: Jul. 1, 1977

[51] Int. Cl.[2] ..... F25B 13/00

[52] U.S. Cl. ..... 165/2; 165/48; 237/48

[58] Field of Search ..... 165/48, 2; 237/50, 53, 237/48; 98/33 A

[56] References Cited

U.S. PATENT DOCUMENTS

| | | | |
|---|---|---|---|
| 2,300,848 | 11/1942 | Shelton | 165/48 X |
| 2,701,103 | 2/1955 | Coleman | 237/48 |
| 2,724,578 | 11/1955 | Swank | 165/48 X |
| 2,780,415 | 2/1957 | Gay | 165/48 X |

*Primary Examiner*—Albert W. Davis, Jr.
*Assistant Examiner*—Margaret A. Focarino
*Attorney, Agent, or Firm*—Fidelman, Wolffe & Waldron

[57] ABSTRACT

In a building an automatically controlled supplemental duct system causes circulation of warm air from the attic space during the heating season and cool air from the basement space during the cooling season when favorable temperature differences exist between said spaces and the internal space which is to be thermally controlled. Absent said favorable temperature differences, a conventional forced air delivery heating - cooling system operates in the conventional manner.

4 Claims, 3 Drawing Figures

SUPPLEMENTAL HEATING AND COOLING SYSTEM

BACKGROUND OF THE INVENTION

The present invention relates generally to the field of energy conservation and more particularly to a supplemental ducting system operating in combination with a conventional forced air delivery heating and cooling system.

Such conventional forced air heating and cooling systems generally comprise a heating and cooling unit which contains, for example, a coil through which, depending upon the season, hot or cold fluid is circulated. Simultaneously air which is to be heated or cooled prior to delivery to the thermally controlled space is forced over the outer surface of the coil. External fins frequently are used to extend the heat transfer surface of the coil in the known manner. In some systems the heating and cooling elements may be separate and operate independently one from the other. The heating unit may comprise a fossil fuel combustion chamber or electrical heating elements, whereas cooling may be accomplished using a coil with two phase evaporating refrigerant circulated therein. Further the heating-cooling unit may be one coil of a heat pump refrigeration cycle wherein said coil serves alternately as a condenser for heating purposes and as an evaporator for cooling.

The air which has been heated or cooled is then distributed throughout the building through a duct network which extends in many branches from the heating or cooling unit to wall, ceiling or floor outlets in the controlled spaces. Return ducts carry air from the temperature controlled spaces back to the heating-cooling unit for reconditioning and recirculation.

These systems may also draw in a portion of air from the external ambient for ventilation purposes, and this inflow adds to the heating or cooling load. However, all of these conventional systems neglect to use the natural thermal energy source for heating and the natural heat sink for cooling which exist in many buildings and residences.

Specifically in the summer the air temperature in the building basement is usually significantly lower than either the external ambient air or the general internal living space temperatures of the building. This favorable basement temperature results from the soil around the foundation walls which remains relatively cool even in the summertime and substantially isolates the basement ambient from rapid temperature changes. In the winter, the air in the attic is heated above the external ambient temperature by the incidence of solar energy on the roof.

Use of these natural reservoirs reduces the thermal load requirements on the heating and cooling systems and as a result effects reductions in consumption of input source energy. What is needed to improve the overall efficiency of residential environmental control is a system which supplements the conventional heating and cooling units by tapping the natural thermal reservoirs available in the home because of the nature of the building construction.

SUMMARY OF THE INVENTION

The supplemental heating and cooling system of this invention includes ducting whereby cool air from the building basement is circulated through the conventional cooling air outlets into the internal space which is being thermally controlled. Cool air from the basement is circulated only when cooling is required and only when a suitable temperature differential exists between the controlled space and the basement. Otherwise the buildings air conditioning system operates in a conventional manner.

Additionally the supplemental system includes ducting whereby warm air from the building attic is circulated through the conventional warm air heating outlets into the internal temperature controlled space. Warm attic air is circulated only when heating is required and only when a suitable temperature differential exists between the controlled space and the attic. Otherwise the building's warm air heating system operates in a conventional manner. Thermostatic controls sense the absolute and differential temperatures and determine when and in which mode, heating or cooling, the supplemental system of this invention is to be actuated.

Accordingly an object of the present invention is to provide supplemental heating and cooling system which utilizes the thermal reservoirs available in the basement and attic air spaces of buildings and residences for temperature conditioning the living and working spaces of those structures.

Another object of the present invention is to provide a system which uses attic air for heating in winter.

Another object of the present invention is to provide a system which uses basement air for cooling in summer.

Another object of the present invention is to provide controls for automatically actuating the supplemental heating and cooling system.

Other objects, advantages and novel features of the present invention will become apparent from the following detailed description of the invention when considered in conjunction with the accompanying drawings in which FIG. 1 is an elevational schematic representation of a building, not to scale, having an attic and basement and a conventional air heating and cooling system.

Figure 1:
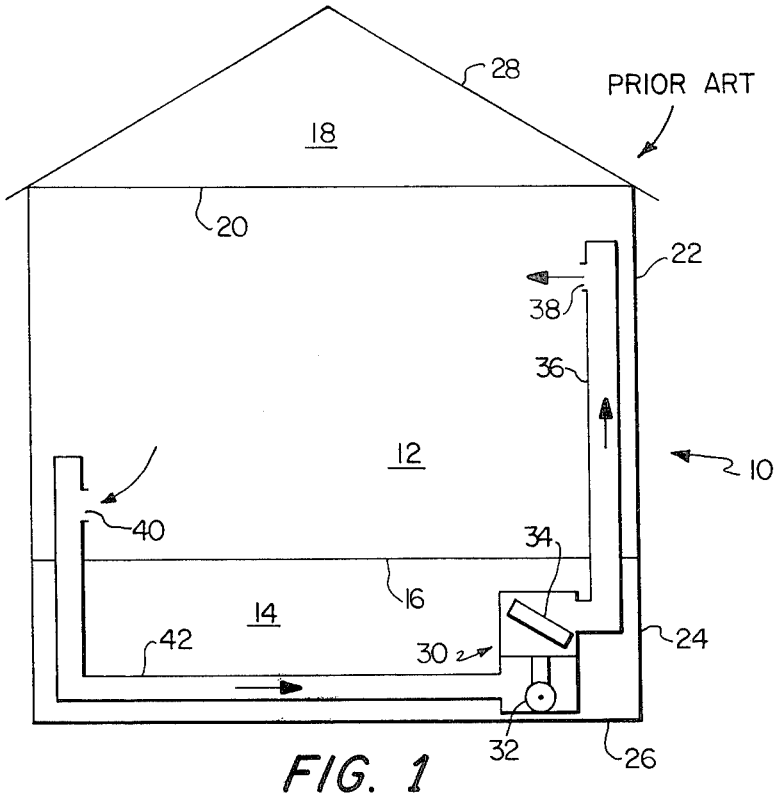

With reference to FIG. 1, a building 10 contains an internal space 12 which is to be air conditioned as required by heating or cooling. This space 12 may be used, for example, for living quarters or for work purposes. The building 10 has a basement space 14 substantially isolated from the conditioned space 12 by a floor 16, and an attic space 18 substantially isolated from the conditioned space 12 by a ceiling 20. Sidewalls 22, a foundation 24 with floor 26, and a roof 28 complete the enclosures of said internal, basement and attic spaces 12, 14, 18 respectively. Construction of the building 10 is conventional, of no special type, and needs no further description herein for the purpose of disclosing the subject invention. Suitable insulation (not shown) and good topographical orientation for the building, as known in the art, would be desirable.

A heating and cooling unit 30, also designated herein as an air conditioning unit 30, for the conditioning and circulation of air throughout the internal space 12 is located in the basement 14. The heating and cooling unit 30 includes a blower 32, and a heat exchanger 34 all of conventional design. A discharge duct 36 carries conditioned air under a positive pressure from the blower 32, and delivers the air into the internal space 12 via a delivery outlet 38 having louvers (not shown). The conditioned air circulates through the internal space 12, and air returns to the heating-cooling unit 30 via a return register 40 and return duct 42. It will be understood that in an alternative embodiment the conditioned space 12 may be subdivided into a plurality of spaces or rooms at the same or different elevations and a plurality of delivery ducts 36 may branch out from the air conditioning unit 30. One or more delivery ducts 36 may service each space or room dependent upon the size and location in the building of that space or room, and a plurality of return ducts 42 may carry air from the spaces back to the air conditioning unit 30. Thermostatic control (not shown) is used to actuate the system into either a heating or cooling mode as conditions require.

Figure 2:
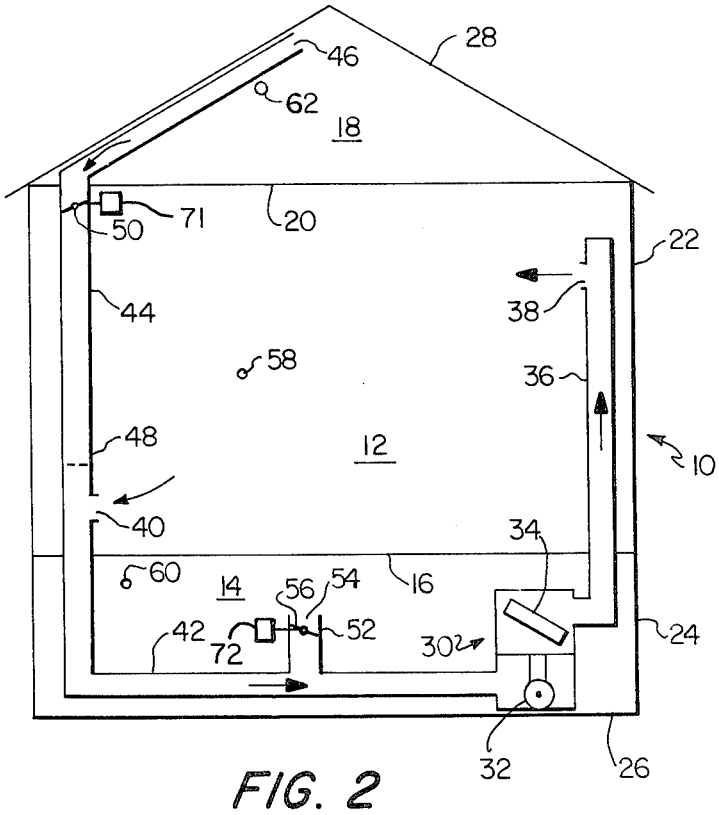
FIG. 2 illustrates the supplemental heating and cooling system of this invention incorporated in the building of FIG. 1.

The above-described air distribution and return network and the system itself are conventional. With reference to FIG. 2, the conventional air conditioning system is modified by the inclusion therein of an attic extension duct 44 which has at one upper end a substantially open inlet 46. The open inlet 46, which may be fitted with a screen and filter (not shown) to prevent inflow of dust particles, is located in the attic space 18. The other lower end 48 of the extension duct 44 joins into the return duct 42 such that the reduced pressure in the ducts 42, 44 due to operation of the blower 32 draws air from the attic space 18 into the air conditioning system along with air returning, as before, through the return register 40. This attic air then flows into the conditioned space 12 via the discharge duct 36 and outlet 38.

A damper 50, of the butterfly type, is located in the attic extension duct 44. When closed, the damper 50 prevents flow of attic air into the duct system and internal conditioned space 12.

A basement inlet duct 52 having an opening 54 in the basement space 14 joins into the return duct 42 such that the reduced pressure in the duct 42 due to operation of the blower 32 draws air from the basement space 14 into the air conditioning system along with air returning, as before, through the return register 40. This basement air then flows into the conditioned space 12 via the discharge duct 36 and outlet 38. A damper 56, of the butterfly type, is located in the basement inlet duct. When closed, the damper 56 prevents flow of basement air into the duct system and internal conditioned space 12.

The opening and closing of the dampers 50, 56 is accomplished automatically by electrically powered actuators 71,72 of any known type, and operation of the system for heating or cooling conditions occurs in response to a central automatic control unit (not shown) as explained more fully hereinafter. Temperature sensors 58, 60, 62 are located in the conditioned, basement and attic spaces respectively to provide signals by wire (not shown) to the central control unit in the known manner.

When the internal space 12 is cooler than a preselected temperature as indicated by the signal from the sensor 58, the control unit starts the blower 32. Also the control unit will cause the damper 50 to be opened by its electrical actuator 71 if the attic air temperature, as indicated by the attic sensor 62, is higher than the temperature of the conditioned space 12. Warmer attic air then enters the extension duct 44, is drawn through the air conditioning unit 30 by the blower 32 and is discharged into the conditioned space 12 thereby heating that space 12. The heat exchanger 34 is not activated in this mode of operation; no fuel or energy is used for this purpose. Circulation of attic air continues until the temperature of the conditioned space 12 reaches the preselected level at which time the blower 32 is automatically turned off.

When in the course of circulating air from the attic 18, the favorable temperature differential between attic air and the conditioned space 12 no longer exists, the attic damper 50 is automatically closed. If the internal conditioned space 12 is not yet up to the preselected temperature level, the control unit actuates the air conditioning unit 30 such that the heat exchanger 34 delivers heat to the air passing over its surface. In this mode the space 12 is heated in a conventional manner until the desired ambient temperature is achieved in the internal space 12. Then the conditioning unit 30 is turned off.

If at the start-up of the system, there exists no favorable differential temperature between attic space 18 and internal space 12, and heating is required, then the damper 50 never opens. The system performs as a conventional forced air heating system, wherein air returns to the conditioning unit 30 via the return regulator 40 and duct 42. Under all conditions where the sensor 58 indicates that heating is required, the damper 56 in the basement 14 is maintained in a closed condition.

It should be understood that the differential between attic and conditioned space temperatures, which determines whether the heating mode is to be supplemental or conventional, may be given a finite value such that air will not be drawn from the attic space 18 if the differential temperature is too small. Otherwise an undesirable protracted period of low heating rate could occur. Also it should be understood that in some applications it may be desirable to operate the blower 32 continuously. In such applications the control unit regulates operation only of the dampers 50, 56 and the heating or cooling of the heat exchanger 34, while the blower 32 continues to operate.

When the internal space 12 requires cooling, the damper 56 in the basement space 14 opens when the air temperature in the basement 14, as indicated by the sensor 60, is less than the temperature of the conditioned space 12. The blower 32 operates, and cooler air from the basement is drawn into the air conditioning unit 30 and delivered to the internal space 12 via the duct 36 and outlet 38. When the space 12 is cooled to a preselected temperature, the blower 32 is turned off. The cooling coil 34 is not actuated in this mode. If before the space 12 reaches the preselected temperature, a favorable temperature differential no longer exists between the basement space 14 and the conditioned space 12, then the damper 56 is automatically closed by actuator 72 and the conditioning unit 30 is actuated to provide cooling of the heat exchanger 34. The system then operates as a conventional forced air cooling system until the preselected temperature is achieved in the internal space 12.

If no favorable differential ever exists between space 14 and internal space 12, and cooling is required, then the damper 56 never opens, and the entire cooling process occurs in the conventional manner with air returning to the cooling unit 30 only via the return register 40 and duct 42. The attic damper 50 is maintained in the closed position whenever the internal space 12 requires cooling.

Energy is saved whenever heating or cooling of the conditioned space 12 is accomplished by the supplemental system of dampers without actuation of the refrigeration system or heating element within the air conditioning unit 30.

Figure 3:
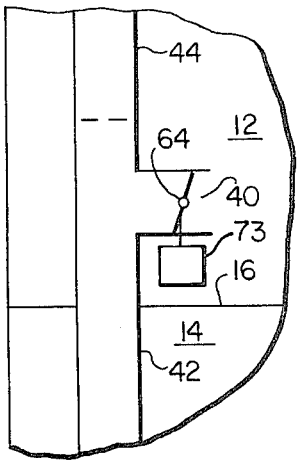
FIG. 3 illustrates, in segment, an alternative embodiment of the system of FIG. 2.

In the system of FIG. 2 described above, return air is always able to leave the conditioned space 12 via the return register 40 and the duct 42 even when one of the dampers 50, 56 is open. The proportion of return air to the conditioning unit 30, which arrives from the space 12 via the register 40, as compared to the quantity of air entering via the open damper, depends upon the relative area, length, and bends in the flow paths. When the proportion of air arriving from the attic or basement damper is large, the supplemental heating or cooling effect will be large and the temperature response in the conditioned space 12 will be immediate and rapid. In FIG. 3 is illustrated an alternative embodiment of the supplemental heating and cooling system of this invention. Therein the return register 40 is fitted with a damper 64 of the butterfly type. This damper 64 is automatically maintained closed by actuator 73 whenever either the attic damper 50 is open or the basement damper 56 is open to provide supplemental air conditioning. The damper 64 is open whenever the system is providing conventional heating or cooling. When the damper 64 is closed, no air returns to the conditioning unit 30 directly from the internal space 12 and the most rapid temperature effect is produced in the supplemental modes of operation. Another advantage in using the damper 64 on the return register 40 is that the internal space can become slightly pressurized by the blower, thereby reducing the ingress of external ambient air and dust to the internal controlled space 12.

It should be understood that the above description is an example of the supplemental heating and cooling system of this invention and is not to be taken as a limitation of the spirit and scope of this invention. For example in an alternative embodiment of this invention the dampers in the system may not be of the butterfly type, but might be comprised of any suitable closure, e.g. flap type covers, or movable louvers, which permit alternatively either passage or non-passage of air flow as required. Also in alternative embodiments, the dampers may operate by other than electrical means, e.g. manual, pneumatic, hydraulic.

Further in building having an attic space but no basement space, the supplemental heating system may be employed without the presence of a supplemental cooling system. Conversely in a building having a basement space but no attic space, the supplemental cooling system may be employed without the presence of a supplemental heating system.

What is claimed is:

1. In a building including an internal air conditioned space, an attic space, an air conditioning unit of the forced air type providing alternatively heated or cooled air, first duct means for carrying said heating or cooled air therethrough from said air conditioning unit to said air conditioned space, and second duct means having return register means for carrying return air therethrough from said air conditioned space back to the inlet of said air conditioning unit, and second damper means in the return register means, the improvement therein comprising:

first supplemental duct means connecting said attic space to said inlet of said air conditioning unit via said second duct means, said first supplemental duct means including first damper means spaced between the attic and the return register means, said first damper means when closed preventing, and when open permitting, flow of air through said first supplemental duct means from said attic space to said air conditioning unit inlet, control means for controlling the temperature in said air conditioned space including temperature sensors in said attic space and said air conditioned space, means to actuate said first damper means, whereby air from said attic space can be circulated to said air conditioned space when said attic space is warmer than said air conditioned space, and means to actuate the second damper means to close the same when the first damper means is open and to open said second damper means when the first damper means is closed.

2. In a building including an internal air conditioned space, a basement space, an attic space, an air conditioning unit of the forced air type providing alternatively heated or cooled air, first duct means for carrying said heated or cooled air therethrough from said air conditioning unit to said air conditioned space, and second duct means having a return register means for carrying return air therethrough from said air conditioned space back to the inlet of said air conditioning unit, and a second damper means in the return register means the improvement therein comprising:

first supplemental duct means for connecting said attic space to said inlet of said air conditioning unit via said second duct means, said first supplemental duct means including first damper means located between the attic space and the return register means, said first damper means when closed preventing, and when open permitting, flow of air through said first supplemental duct means from said attic space to said air conditioning unit inlet, and included in said control means a temperature sensor in said attic and means for actuating said first damper means, whereby air from said attic can be circulated to said air conditioned space when said attic is warmer than said air conditioned space, and means for actuating the second damper means so that said second damper means is closed when the first or third damper means is open and the second damper means is open when the third and first damper means are closed.

3. A method of supplementally heating a building including an internal conditioned space, an attic space, an air conditioning unit of the forced air type, first duct means for carrying air therethrough from said air conditioning unit to said air conditioned space, second duct means having a return register means for carrying return air therethrough from said air conditioned space back to said air conditioning unit, a second damper means in the return register means, first supplemental duct means for carrying air therethrough from said attic space to the inlet of said air conditioning unit via said second duct means, a first damper means in said first supplemental duct means, controls to sense temperatures and to operate said air conditioning unit and said first damper means, comprising the steps of:

sensing by temperature measurement that a requirement for heating exists in said internal conditioned space, sensing, by temperature measurement, that the temperature in said attic space exceeds the temperature in said conditioned space, opening the first damper means in the first supplemental duct means, closing the second damper means in the return register means, operating the blower in said air conditioning unit for flowing air through said first supplemental duct means and second duct means from said attic space to said air conditioning inlet.

4. A method of supplementally heating and cooling a building including an internal conditioned space, an attic space, a basement space, an air conditioning unit of the forced air type, first duct means for carrying air therethrough from said air conditioning unit to said air conditioned space, second duct means having a return register means for carrying return air therethrough from said air conditioned space back to the inlet of said air conditioning unit, first supplemental duct means for carrying air therethrough from said attic space to the inlet of said air conditioning unit via said second duct means, third duct means for carrying air therethrough from said basement space to the inlet of said air conditioning unit, a second damper means in said return register means, a first damper means in said first supplemental duct means, said first damper means being spaced between the return register means and the attic, a third damper means in said third duct means, controls to sense temperatures and to operate said air conditioning unit and said dampers, comprising the steps of:

sensing by temperature measurement that a requirement for heating or cooling exists in said internal conditioned space, sensing the temperatures in said attic space and said basement space, opening the first damper means in the first supplemental duct means when a heating requirement exists in said conditioned space and said attic space temperature is higher than the temperature in said conditioned space, opening the third damper means in the third duct means when a cooling requirement exists in said conditioned space and said basement space temperature is lower than the temperature in said conditioned space, closing the third damper means in the third duct means when the first damper means in the first supplemental duct means is open, closing the first damper means in the first supplemental duct means when the third damper means in the third duct means is open, closing the second damper means in the return register means when the damper means in either the first supplemental or third duct means are open, opening the second damper means in the return register means when the damper means in the first supplemental and third duct means are closed, and operating said blower in said air conditioning unit.

* * * * *